US010152923B2

(12) United States Patent
Li et al.

(10) Patent No.: US 10,152,923 B2
(45) Date of Patent: Dec. 11, 2018

(54) DISPLAY PANEL, DRIVING METHOD, AND ELECTRONIC DEVICE

(71) Applicants: SHANGHAI TIANMA AM-OLED CO., LTD., Shanghai (CN); TIANMA MICRO-ELECTRONICS CO., LTD., Shenzhen (CN)

(72) Inventors: Yue Li, Shanghai (CN); Dong Qian, Shanghai (CN); Dongxu Xiang, Shanghai (CN); Renyuan Zhu, Shanghai (CN); Gang Liu, Shanghai (CN)

(73) Assignees: SHANGHAI TIANMA AM-OLED CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 0 days.

(21) Appl. No.: 15/612,745

(22) Filed: Jun. 2, 2017

(65) Prior Publication Data

US 2017/0270868 A1 Sep. 21, 2017

(30) Foreign Application Priority Data

Nov. 30, 2016 (CN) ..... 2016 1 1089273

(51) Int. Cl.
*G09G 3/3266* (2016.01)
*G09G 3/3258* (2016.01)
*G09G 3/20* (2006.01)

(52) U.S. Cl.
CPC ..... *G09G 3/3266* (2013.01); *G09G 3/2003* (2013.01); *G09G 3/3258* (2013.01);
(Continued)

(58) Field of Classification Search
CPC .. G09G 3/3266; G09G 3/2003; G09G 3/3258; G09G 2300/0443;
(Continued)

(56) References Cited

U.S. PATENT DOCUMENTS 8,624,820 B2 * 1/2014 Kim ..... G09G 3/3614 345/100
9,136,283 B2 * 9/2015 Song ..... H01L 27/124
(Continued)

FOREIGN PATENT DOCUMENTS

CN 103021325 B 11/2015
CN 105575333 A 5/2016

*Primary Examiner* — Jose Soto Lopez
(74) *Attorney, Agent, or Firm* — Alston & Bird LLP

(57) ABSTRACT

A display panel includes: pixel units, where each pixel unit includes sub-pixels in a row direction; gate lines and data lines crossed to define sub-pixel regions, each sub-pixel region includes one sub-pixel and an organic light emitting diode (OLED) driving circuit, OLED driving circuits in a same column are connected with one data line, OLED driving circuits in a same row are connected with one gate line; and at least two sub-pixel regions adjacent in a column direction being a first region and a second region respectively, and in the first and second regions in a same group, the sub-pixel in the first region is connected with the OLED driving circuit in the second region, and the sub-pixel in the second region is connected with the OLED driving circuit in the first region.

18 Claims, 7 Drawing Sheets

(52) U.S. Cl.
CPC ..... *G09G 2300/0426* (2013.01); *G09G 2300/0443* (2013.01); *G09G 2300/0452* (2013.01); *G09G 2310/0289* (2013.01); *G09G 2310/08* (2013.01); *G09G 2330/023* (2013.01)

(58) Field of Classification Search
CPC ..... G09G 2310/0289; G09G 2330/023; G09G 2300/0452; G09G 2300/0426; G09G 2310/08
See application file for complete search history.

(56) References Cited

U.S. PATENT DOCUMENTS

| | | | | |
|---|---|---|---|---|
| 9,824,661 | B2 * | 11/2017 | Kim | G09G 3/3648 |
| 9,985,052 | B2 * | 5/2018 | Kaneyasu | H01L 27/1225 |
| 2006/0103323 | A1 * | 5/2006 | Eom | G09G 3/3233 315/169.3 |
| 2006/0120160 | A1 * | 6/2006 | Park | G02F 1/1368 365/185.22 |
| 2013/0300725 | A1 * | 11/2013 | Jeong | G09G 3/3225 345/212 |
| 2015/0161934 | A1 * | 6/2015 | Chen | G09G 3/2025 345/691 |
| 2015/0221260 | A1 * | 8/2015 | Cho | G09G 3/3413 345/691 |
| 2015/0248868 | A1 * | 9/2015 | Mori | G09G 3/3659 345/694 |
| 2016/0056213 | A1 * | 2/2016 | Kwak | G09G 3/3208 315/161 |
| 2016/0189593 | A1 * | 6/2016 | Lee | G09G 3/2003 345/691 |

* cited by examiner

DISPLAY PANEL, DRIVING METHOD, AND ELECTRONIC DEVICE

CROSS REFERENCE TO RELATED APPLICATION

The present application claims the priority to Chinese Patent Application No. CN201611089273.3, titled "DISPLAY PANEL, DRIVING METHOD, AND ELECTRONIC DEVICE", filed on Nov. 30, 2016 with the State Intellectual Property Office of the PRC, which is incorporated herein by reference in its entirety.

BACKGROUND

With the development of science and technology, more electronic devices with display functions are applied in people's daily life and work. The electronic devices with the display functions bring a great convenience to people's daily life and work and become indispensable and important tools today.

An important part of an electronic device for realizing a display function is a display panel. An OLED display panel being one of the mainstream display panels performs image display through an OLED unit. However, high display driving power consumption remains a disadvantage for the current OLED display technology.

SUMMARY

The present disclosure provides a display panel, a driving method, and an electronic device, to reduce display driving power consumption.

The present disclosure has the following embodiments.

A display panel includes:

multiple pixel units arranged in an array, where each of the pixel units includes multiple sub-pixels arranged in a row direction of the array;

multiple gate lines arranged in parallel;

multiple data lines arranged in parallel, where the data lines and the gate lines are insulated from each other and crossed to define multiple sub-pixel regions, the sub-pixel regions are in a one-to-one correspondence with the sub-pixels, each of the sub-pixel regions is provided with one sub-pixel, each of the sub-pixel regions is also provided with an OLED driving circuit, OLED driving circuits in a same column are connected with one of the data lines, and OLED driving circuits in a same row are connected with one of the gate lines; and at least two sub-pixel regions adjacent to each other in a column direction of the array, where one of the at least two sub-pixel regions is a first region, the other one of the at least two sub-pixel regions is a second region, and in the first region and the second region in a same group, the sub-pixel in the first region is connected with the OLED driving circuit in the second region, and the sub-pixel in the second region is connected with the OLED driving circuit in the first region.

The present disclosure also provides a driving method, which is applied to the above display panel. The driving method includes:

scanning the OLED driving circuits in all even rows and the OLED driving circuits in all odd rows in a time-sharing manner;

holding, by each of the OLED driving circuits in all the odd rows, a data signal of the OLED driving circuit at a previous frame, when the OLED driving circuits in all the even rows are sequentially scanned in a preset scanning order;

holding, by each of the OLED driving circuits in all the even rows, a data signal of the OLED driving circuit at a previous frame, when the OLED driving circuits in all the odd rows are sequentially scanned in a preset scanning order;

inputting, by each of the OLED driving circuits in the first regions, the data signal to the sub-pixel in the second region in a same group with the first region, when the OLED driving circuit in the first region is scanned; and inputting, by each of the OLED driving circuits in the second regions, the data signal to the sub-pixel in the first region in a same group with the second region, when the OLED driving circuit in the second region is scanned.

The present disclosure also provides a driving method, which is applied to the above display panel. The driving method includes:

scanning the OLED driving circuits in all even rows and the OLED driving circuits in all odd rows in a time-sharing manner;

displaying, by the sub-pixels connected with the OLED driving circuits in all the even rows, a frame of image and turning off the sub-pixels connected with the OLED driving circuits in all the odd rows, when the OLED driving circuits in all the even rows are sequentially scanned in a preset scanning order;

displaying, by the sub-pixels connected with the OLED driving circuits in all the odd rows, a frame of image and turning off the sub-pixels connected with the OLED driving circuits in all the even rows, when the OLED driving circuits in all the odd rows are sequentially scanned in a preset scanning order;

inputting, by each of the OLED driving circuits in the first regions, the data signal to the sub-pixel in the second region in a same group with the first region, when the OLED driving circuit in the first region is scanned; and inputting, by each of the OLED driving circuits in the second regions, the data signal to the sub-pixel in the first region in a same group with the second region, when the OLED driving circuit in the second region is scanned.

The present disclosure also provides an electronic device, which includes the above display panel.

As can be seen from the above description, in the display panel, the driving method and the electronic device provided according to the technical solutions of the present disclosure, in the first region and the second region in a same group, the sub-pixel in the first region is connected with the OLED driving circuit in the second region, and the sub-pixel in the second region is connected with the OLED driving circuit in the first region. In a row of sub-pixel regions including the first regions, a part of the sub-pixel regions are the first regions, another part of the sub-pixel regions are the third regions. In a row of sub-pixel regions including the second regions, a part of the sub-pixel regions are the second regions, another part of the sub-pixel regions are the third regions. The driving circuit and the sub-pixel in a same third region are connected.

During driving the display panel to display, when a row of the sub-pixel regions including the first regions are scanned, the sub-pixels in the third regions of the row of sub-pixel regions may be lighted, and the sub-pixels in the second regions, which are in a same group with the first regions of the row of sub-pixel regions, may also be lighted;

and when a row of the sub-pixel regions including the second regions are scanned, the sub-pixels in the third regions of the row of sub-pixel regions may be lighted, and the sub-pixels in the first regions, which are in a same group with the second regions of the row of sub-pixel regions, may also be lighted. That is, when any row of sub-pixel regions are scanned, a part of the sub-pixels of the sub-pixel regions in the scanned row may be lighted, and a part of the sub-pixels of the sub-pixel regions in a row adjacent to the scanned row may be lighted. Then all rows of the sub-pixels including the first regions and all rows of the sub-pixels including the second regions can be scanned in a time-sharing manner, thereby reducing the power consumption.

BRIEF DESCRIPTION OF THE DRAWINGS

The accompanying drawings to be used in the description of the embodiments or the conventional technology are described briefly as follows. It is obvious that the accompanying drawings in the following description show only some embodiments of the present disclosure. For those skilled in the art, other drawings may be obtained according to these accompanying drawings without any creative work.

DETAILED DESCRIPTION OF THE EMBODIMENTS

The technical solution according to the embodiments of the present disclosure will be described clearly and completely as follows in conjunction with the accompanying drawings. The described embodiments are only exemplary according to the present disclosure. All the other embodiments obtained by those skilled in the art based on the present disclosure belong to the protection scope of the present disclosure.

The following is the detailed description in conjunction with the accompanying drawings.

Figure 1:
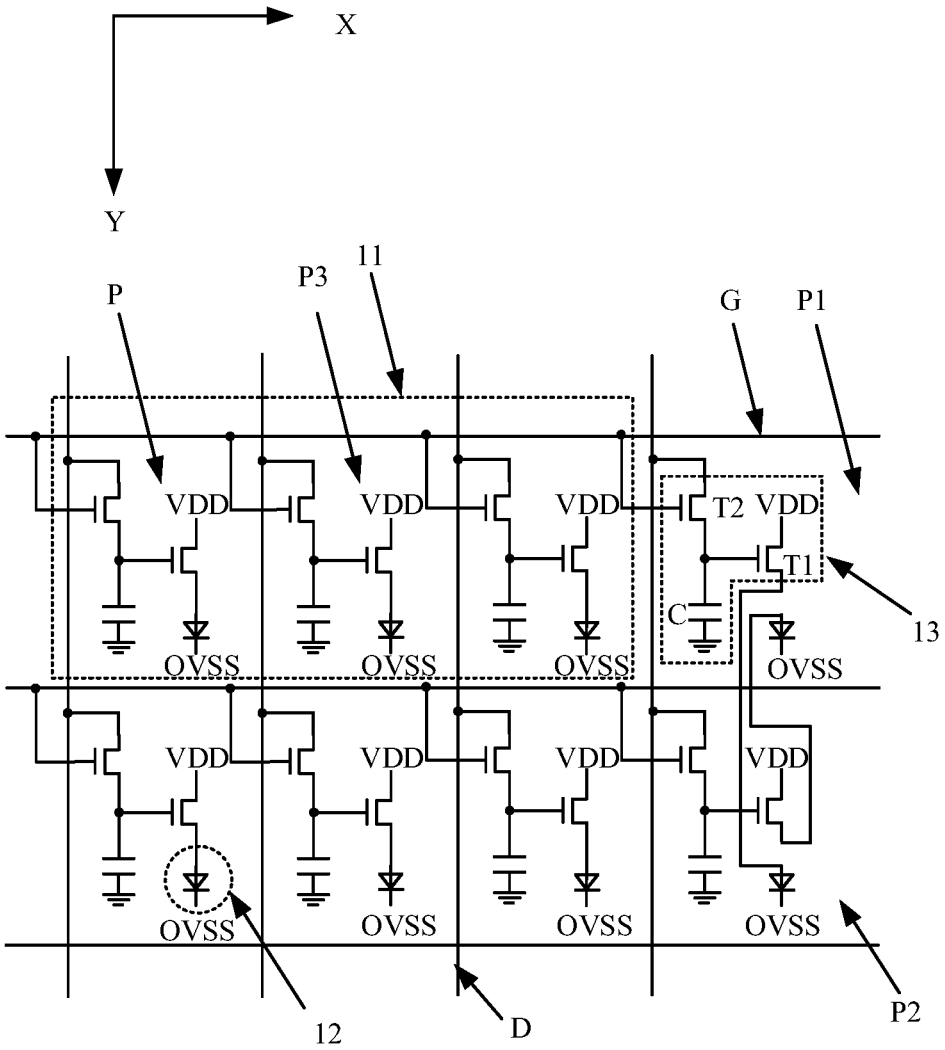
FIG. 1 is a schematic structural diagram of a display panel according to an embodiment of the present disclosure.

FIG. 1 is a schematic structural diagram of a display panel according to an embodiment of the present disclosure. The display panel includes: multiple pixel units 11 arranged in an array, where each of the pixel units 11 includes three sub-pixels 12 arranged in a row direction X of the array; multiple gate lines G in parallel; multiple data lines D in parallel, where the data lines D and the gate lines G are insulated from each other and crossed to define multiple sub-pixel regions P, and each of the sub-pixel regions P is in a one-to-one correspondence with a sub-pixels 12, and each of the sub-pixel regions P is provided with one sub-pixel 12.

Since the pixel units 11 are arranged in the array and each of the pixel units 11 includes three sub-pixels 12 arranged in the row direction X, the sub-pixels 12 are arranged in an array. The number of rows of the array corresponding to the sub-pixels 12 is the same as the number of rows of the array corresponding to the pixel units 11, and the number of columns of the array corresponding to the sub-pixels 12 is three times as great as the number of columns of the array corresponding to the pixel units 11.

The sub-pixel regions P are in a one-to-one correspondence with the sub-pixels 12, so the sub-pixel regions P are arranged in an array, and the array of the sub-pixel regions P is the same as the array of the sub-pixels 12. That is, the number of rows of the array corresponding to the sub-pixel regions P is the same as the number of rows of the array corresponding to the sub-pixels 12, and the number of columns of the array corresponding to the sub-pixel regions P is the same as the number of columns of the array corresponding to the sub-pixels 12.

Each of the sub-pixel regions P is provided with an OLED driving circuit 13. The OLED driving circuits 13 are in a one-to-one correspondence with the sub-pixel regions, then the OLED driving circuits 13 are arranged in an array, and the array of the OLED driving circuits 13 is the same as the array of the sub-pixel regions P. That is, the number of rows of the array corresponding to the OLED driving circuits 13 is the same as the number of rows of the array corresponding to the sub-pixel regions P, and the number of columns of the array corresponding to the OLED driving circuits 13 is the same as the number of columns of the array corresponding to the sub-pixel regions P.

The OLED driving circuits 13 in a same column are connected with one of the data lines D, and the OLED driving circuits 13 in different columns are connected with different data lines D. The OLED driving circuits 13 in a same row are connected with one of the gate lines G, and the OLED driving circuits 13 in different rows are connected with different gate lines G.

In the display panel according to the embodiment of the present disclosure, there are at least two sub-pixel regions P adjacent to each other in a column direction Y of the array. And one of the at least two sub-pixel regions P is a first region P1, the other one of the at least two sub-pixel regions P is a second region P2. In the first region P1 and the second region P2 in a same group, the sub-pixel 12 in the first region P1 is connected with the OLED driving circuit 13 in the second region P2, and the sub-pixel 12 in the second region P2 is connected with an OLED driving circuit 13 in the first region P1.

In a row of the sub-pixel regions P including the first regions P1, one part of the sub-pixel regions P is the first regions P1, the other part of the sub-pixel regions P are third regions P3. In a row of the sub-pixel regions P including the second regions P2, one part of the sub-pixel regions P are the second regions P2, the other part of the sub-pixel regions P are third regions P3. The first region P1 and the second region P2 are arranged in different rows of the sub-pixel regions P. The OLED driving circuit 13 and the sub-pixel 12 in a same third region P3 are connected.

In the display panel, when a row of the sub-pixel regions P including the first regions P1 are scanned, the sub-pixels 12 in the third regions P3 of the row of the sub-pixel regions P may be lighted, and the sub-pixels 12 in the second regions P2, which are in the row of sub-pixel regions P including the second regions P2, may also be lighted. And when a row of the sub-pixel regions P including the second regions P2 are scanned, the sub-pixels 12 in the third regions P3 of the row of the sub-pixel regions P may be lighted, and the sub-pixels 12 in the first regions P1, which are in the row of sub-pixel regions P including the first regions P1, may also be lighted. The first region P1 and the second region P2 in a same group are respectively arranged in two adjacent rows of the sub-pixel regions P. In this way, when the display panel is driven to display, all rows of the pixel units including the first regions P1 and all rows of the pixel units including the second regions P2 can be scanned in a time-sharing manner, at least part of sub-pixels in both odd rows and even rows are lighted, thereby improving the display effect, prolonging the service life of the sub-pixels, and reducing the power consumption.

A display panel provided according to an embodiment of the present disclosure is an OLED display panel. The sub-pixel 12 is an OLED unit. The OLED unit includes an anode, a cathode opposite to the anode and a light-emitting functional layer between the anode and the cathode. The cathode is configured to input a cathode voltage.

The OLED driving circuit 13 includes a driving transistor T1. The driving transistor T1 includes a gate, a first electrode and a second electrode. The gate of the driving transistor T1 is configured to receive a data signal. The first electrode of the driving transistor T1 is configured to receive a supply voltage signal VDD. The second electrode of the driving transistor T1 is electrically connected with the anode of the OLED unit corresponding to the driving transistor. The cathode of the OLED unit receives a supply voltage signal OVSS.

As shown in FIG. 1, the OLED driving circuit 13 also includes: a first switching transistor T2 and a capacitor C. The first switching transistor T2 includes: a gate, a first electrode and a second electrode. The gate of the first switching transistor T2 is electrically connected with one of the gate lines G The first electrode of the first switching transistor T2 is electrically connected with one of the data lines D. The second electrode of the first switching transistor T2 is electrically connected with the gate of the driving transistor T1 and one plate of the capacitor C, and the other plate of the capacitor C is grounded. When the first switching transistor T2 is turned on, a data signal is inputted by one of the data lines D to the gate of the driving transistor T1.

It should be noted that, in the display panel according to the embodiment of the present disclosure, a 2T1C driving circuit (a driving circuit includes two transistors and one capacitor) is described as an example. In other embodiments, the OLED driving circuit 13 may also be a 6T1C driving circuit (a driving circuit includes six transistors and one capacitor) or a 7T1C driving circuit (a driving circuit includes seven transistors and one capacitor). In the display panel according to the embodiments of the present disclosure, a specific structure of the OLED driving circuit 13 is not limited to the above examples.

In a case that the display panel is an OLED display panel, the display panel includes an array substrate and multiple OLED units arranged in an array on the array substrate. The array substrate includes: a substrate and gate lines G, data lines D and OLED driving circuits 13 arranged on the substrate. An anode of each of the OLED units is arranged on the surface of the array substrate. Anodes of different OLED units are insulated with each other. Anodes of the OLED units are connected with the OLED driving circuits 13 in a one-to-one correspondence. All the OLED units may share a same conductive layer as cathodes, that is, one conductive layer may be taken as a common cathode of all the OLED units.

The capacitor of the OLED driving circuit 13 is configured to store a data signal. When no scanning signal is inputted to the gate line G, the capacitor C discharges, and the data signal stored in the capacitor C may be configured to control the driving transistor T1 to be turned on, so that the sub-pixel 12 connected with the OLED driving circuit 13 is conductive with a power supply. If the supply voltage signal is continuously outputted by the power supply at this time, the sub-pixel 12 may be lighted continuously.

Figure 2:
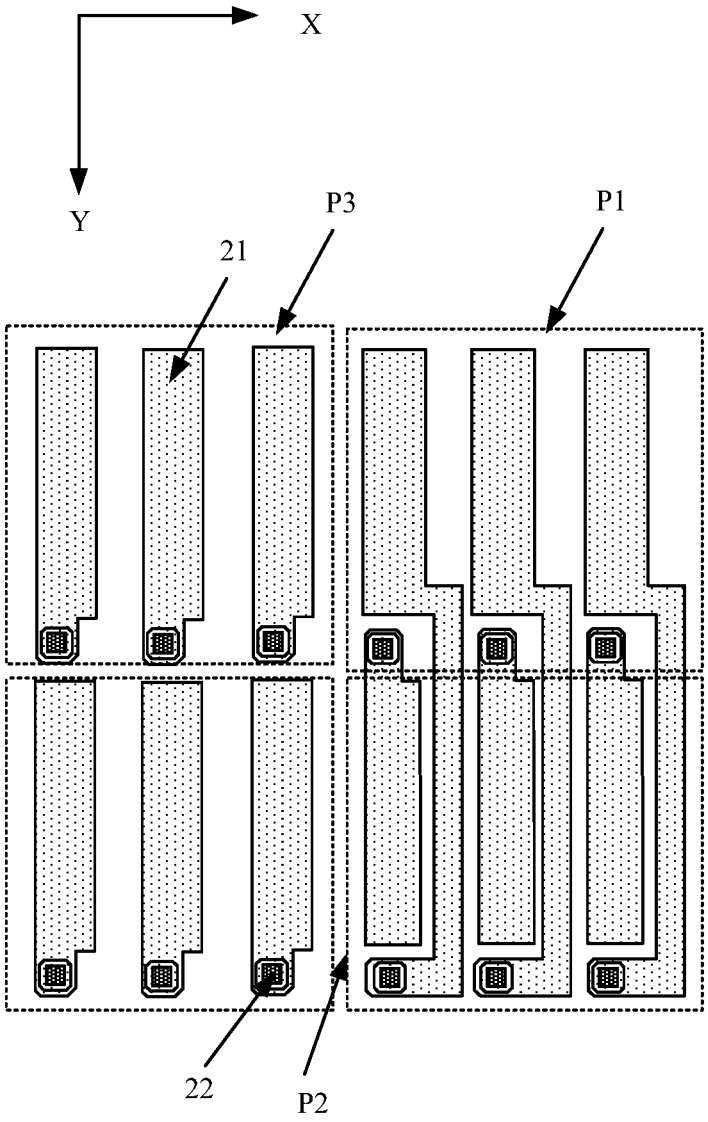
FIG. 2 is a schematic structural diagram of sub-pixel electrodes in a display panel according to an embodiment of the present disclosure.

Referring to FIG. 2, which is a schematic structural diagram of sub-pixel electrodes in a display panel according to an embodiment of the present disclosure, an anode 21 of the sub-pixel in the first region P1 extends to the second region P2, and is connected with the OLED driving circuit in the second region P2 through a via hole 22 in the first region P1. An anode 21 of the sub-pixel in the second region P2 extends to the first region P1, and is connected with an OLED driving circuit in the first region P1 through a via hole 22 in the first region P1. An anode 21 and an OLED driving circuit (which is not shown in FIG. 2) in a same third region P3 are electrically connected through a via hole 22 in the third region P3. The OLED driving circuit in each sub-pixel region is not shown in FIG. 2.

In the electrode structure shown in FIG. 2, the anode 21 of the sub-pixel in the first region P1 may be electrically connected with the OLED driving circuit in the second region P2 in a same group with the first region P1, and the anode 21 of the sub-pixel in the second region P2 may be electrically connected with the OLED driving circuit in the first region P1 in a same group with the second region P2, so that all rows of the pixel units including the first regions P1 and all rows of the pixel units including the second regions P2 can be driven in a time-sharing manner, to reduce the driving power consumption of the display panel. And in the production procedure, it is required only to change relevant mask plates for fabricating the anode 21, without increasing the production procedure. In this way, the production procedure is simple.

Figure 3:
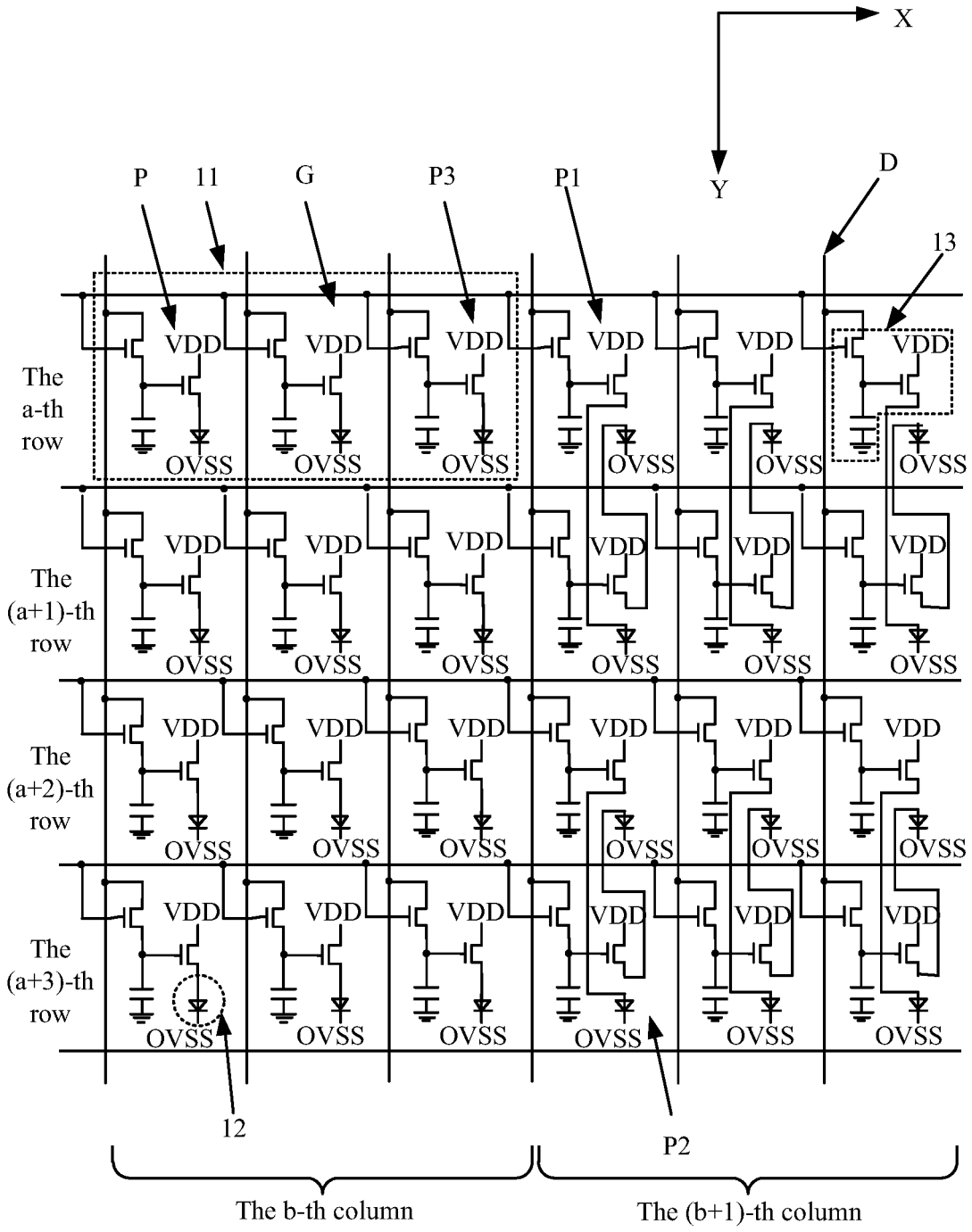
FIG. 3 is a schematic structural diagram of a display panel according to an embodiment of the present disclosure.

Referring to FIG. 3, which is a schematic structural diagram of a display panel according to an embodiment of the present disclosure. The display panel includes total 2N rows of the pixel units 11, and N is a positive integer (N is not shown in FIG. 3). It is assumed that the display panel includes total M columns of the pixel units 11, and M is a positive integer (M is not shown in FIG. 3). In a row direction X, the M columns of the pixel units 11 are the first column of the pixel units to the M-th column of the pixel units respectively. In a column direction Y, the 2N rows of the pixel units 11 are the first row of the pixel units to the 2N-th row of the pixel units respectively.

Eight pixel units arranged in an array from the a-th row to the (a+3)-th row and from the b-th column to the (b+1)-th column are shown in FIGS. 3, and $0<a\leq 2N-3$, a is an odd integer, $0<b\leq M-1$, and b is an odd integer. The number of columns and the number of rows of the pixel units 11 may be designed based on the panel size and the resolution ratio required. And the number of columns and the number of rows of the pixel units 11 are not limited to the embodiment shown in FIG. 3.

In the display panel according to the embodiment of the present disclosure, in any row of the sub-pixel regions P, the first regions P1 and the third regions P3 are arranged alternatively. In two adjacent columns of the pixel units 11, the sub-pixel regions P in one of the two adjacent columns of the pixel units 11 are the third regions, and the sub-pixel regions P in the other one of the two adjacent columns of the pixel units 11 are the second regions P2 or the first regions P1. The sub-pixel region P is the first region P1, or the second region P2, or the third region P3.

In the embodiment shown in FIG. 3, for the pixel units 11 in odd columns, the sub-pixel 12 and the OLED driving circuit 13 in a same sub-pixel region P are connected with each other. That is, the sub-pixel regions P corresponding to the pixel units 11 in odd columns are the third regions, such as the sub-pixel regions P corresponding to the pixel units 11 in the b-th column are the third regions P3.

For the pixel units 11 in even columns, the sub-pixel regions P corresponding to each of the pixel units 11 in the a-th row are the first regions P1, the sub-pixel regions P corresponding to each of the pixel units 11 in the (a+1)-th row are the second regions P2; and the sub-pixel regions P corresponding to each of the pixel units 11 in the (a+2)-th row are the first regions P1, the sub-pixel regions P corresponding to each of the pixel units 11 in the (a+3)-th row are the second regions P2. The first regions P1 corresponding to the pixel unit 11 in the a-th row are in a same group with the second regions P2 corresponding to the pixel unit 11 in the (a+1)-th row respectively. The first regions P1 corresponding to the pixel unit 11 in the (a+2)-th row are in a same group with the second regions P2 corresponding to the pixel unit 11 in the (a+3)-th row respectively. In sub-pixel regions P corresponding to the pixel units 11 in even columns, the sub-pixel regions P in odd rows are the first regions P1, and the sub-pixel regions P in even rows are the second regions P2.

In other embodiments, for the pixel units 11 in even columns, the sub-pixel 12 and the OLED driving circuit 13 in a same sub-pixel region P are connected with each other. For the pixel units 11 in odd columns, each of the sub-pixel regions P corresponding to each of the pixel units 11 in the a-th row is the first region P1; each of the sub-pixel regions P corresponding to each of the pixel units 11 in the (a+1)-th row is the second region P2; and the first region P1 corresponding to the pixel unit 11 in the a-th row is in a same group with the second region P2 corresponding to the pixel unit 11 in the (a+1)-th row and in a same column with the first region P1. The sub-pixel regions P corresponding to the pixel units 11 in the even column are the third regions P3. In the sub-pixel regions P corresponding to the pixel units 11 in odd columns, the sub-pixel regions P in odd rows are the first regions P1, and the sub-pixel regions P in even rows are the second regions P2.

In other embodiments, for the first region P1 and the second region P2 in a same group, the first region P1 is arranged in the pixel unit 11 in an even row, and the second region P2 is arranged in the pixel unit 11 in an odd row.

In the embodiment shown in FIG. 3, in an odd row, a pixel unit 11 including three third regions P3 and a pixel unit 11 including three first regions P1 are arranged alternatively. In an even row, a pixel unit 11 including three third regions P3 and a pixel unit 11 including three second regions P2 are arranged alternatively. And the pixel unit including the third region P3 is arranged in an odd column, and the pixel unit 11 including the first region P1 or the second region P2 is arranged in an even column. In this way, when the display panel is driven to display, all odd rows and all even rows can be scanned in a time-sharing manner, at least part of sub-pixels in both odd rows and even rows are lighted, thereby reducing the power consumption, and prolonging the service life.

It should be noted that, in the embodiment shown in FIG. 3, each of the pixel units 11 in an odd column and an even column adjacent with each other includes three sub-pixels 12. Alternatively, each of the pixel units 11 in an odd column and an even column adjacent with each other may include four sub-pixels 12 or more. Specifically, the display panel shown in FIG. 3 using RGB display driving, the pixel unit 11 includes three sub-pixels 12. The three sub-pixels 12 of a same pixel unit 11 are a sub-pixel emitting a red light R, a sub-pixel emitting a green light G and a sub-pixel emitting a blue light B respectively. An arrangement of the three sub-pixels of the same pixel unit 11 in the row direction X may be set randomly, which is not limited herein. Alternatively, the pixel unit 11 in the display panel may include four sub-pixels 12. And the four sub-pixels may use a RGBW display mode, then each pixel unit 11 includes four sub-pixels 12 being a sub-pixel emitting a red light R, a sub-pixel emitting a green light G, a sub-pixel emitting a blue light B and a sub-pixel emitting a white light W respectively. Alternatively, the four sub-pixels may use a RGBY display mode, then each pixel unit 11 includes four sub-pixels 12 being a sub-pixel emitting a red light R, a sub-pixel emitting a green light G, a sub-pixel emitting a blue light B and a sub-pixel emitting a yellow light Y respectively. It should be noted that, in the embodiment shown in FIG. 3, each of the pixel units 11 in an odd column and an even column adjacent to each other includes three sub-pixels 12. Alternatively, each of the pixel units 11 in an odd column and an even column adjacent with each other include one sub-pixel 12. And the sub-pixel 12 in one column is the third region P3, the sub-pixel 12 in a column adjacent to the one column is the first region P1 or the second region P2.

Figure 4:
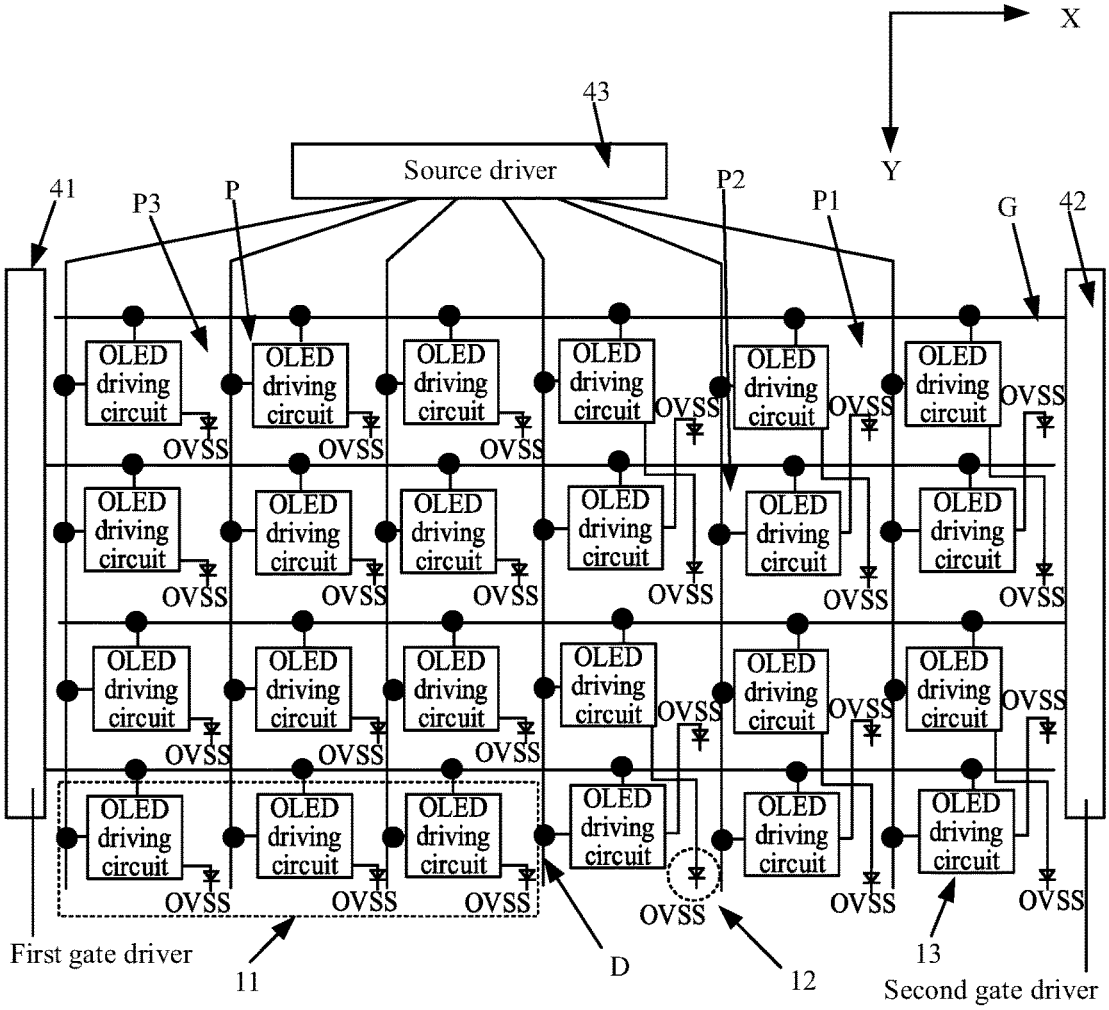
FIG. 4 is a schematic structural diagram of a display panel according to an embodiment of the present disclosure.

Referring to FIG. 4, which is a schematic structural diagram of a display panel according to an embodiment of the present disclosure, in the display panel, the gate lines G are connected with gate drivers configured to provide scanning signals to the gate lines G The data lines D are connected with a source driver 43 configured to provide data signals to the data lines D.

And, the gate drivers include a first gate driver 41 and a second gate driver 42. The OLED driving circuits 13 in an even row are connected with the first gate driver through the gate line G connected with the OLED driving circuits 13. The OLED driving circuits 13 in an odd row are connected with the second gate driver through the gate line G connected with the OLED driving circuits 13.

When the display panel is driven to display, the first gate driver 41 is configured to scan the OLED driving circuits 13 in all the even rows in a preset scanning order, the second gate driver 42 is configured to scan the OLED driving circuits 13 in all the odd rows in a preset scanning order.

As shown in FIG. 4, the first gate driver 41 and the second gate driver 42 are arranged at both ends of the gate lines G respectively, thereby reducing the width of the frame area, which is beneficial to a narrow frame design.

It should be noted that, the gate drivers are not limited to the arrangement shown in FIG. 4, which includes both the first gate driver 41 and the second gate driver 42. It can be arranged only one gate driver at a single side.

In the display panel according to the embodiment of the present disclosure, when any row of sub-pixel regions are scanned, a part of the sub-pixels of the sub-pixel regions in the scanned row may be lighted, and a part of the sub-pixels of the sub-pixel regions in a row adjacent to the scanned row may be lighted. Then all rows of sub-pixels including the first region and all rows of sub-pixels including the second region can be scanned in a time-sharing manner, thereby reducing the power consumption.

Based on the embodiment of the above display panel, a driving method is provided according to another embodiment of the present disclosure. The driving method is configured to drive the display panel in the above embodiment to display, and the driving method includes: scanning the OLED driving circuits in all even rows and the OLED driving circuits in all odd rows in a time-sharing manner; holding, by each of the OLED driving circuits in all the odd rows, a data signal of the OLED driving circuit at a previous frame, when the OLED driving circuits in all the even rows are sequentially scanned in a preset scanning order; and holding, by each of the OLED driving circuits in all the even rows, a data signal of the OLED driving circuit at a previous frame, when the OLED driving circuits in all the odd rows are sequentially scanned in a preset scanning order.

When the OLED driving circuit holds the data signal of the OLED driving circuit at the previous frame, no scanning signal is inputted to the gate line connected with the OLED driving circuit, data signals are continuously inputted to the data line connected with the OLED driving circuit, a supply voltage is continuously outputted by a power supply, the anode of the sub-pixel connected with the OLED driving circuit is conductive with the power supply by the capacitor in the OLED driving circuit discharging, and a supply voltage signal is inputted to the sub-pixel and the sub-pixel is in a light-emitting state.

Each of the OLED driving circuits in the first regions inputs the data signal to the sub-pixel in the second region in a same group with the first region, when the OLED driving circuit in the first region is scanned. Each of the OLED driving circuits in the second regions inputs the data signal to the sub-pixel in the first region in a same group with the second region, when the OLED driving circuit in the second region is scanned.

A scanning timing of the OLED driving circuits in all even rows and a scanning timing of the OLED driving circuits in all odd rows are preformed alternatively. After the OLED driving circuits in all the odd rows are sequentially scanned in a preset scanning order, the OLED driving circuits in all the even rows are sequentially scanned in a preset scanning order. Alternatively, after the OLED driving circuits in all the even rows are sequentially scanned in a preset scanning order, the OLED driving circuits in all the odd rows are sequentially scanned in a preset scanning order.

In a case that the OLED driving circuits in all the even rows and the OLED driving circuits in all the odd rows are scanned in a time-sharing manner, the sub-pixel regions corresponding to the pixel units in an odd column in the display panel are the third regions; and in the sub-pixel regions corresponding to the pixel units in an even column, the first regions and the second regions in a same column of the sub-pixel regions are arranged alternatively in a column Y; the sub-pixel region corresponding to the pixel unit in an even column is the first region or the second region; and all the three sub-pixel regions corresponding to a same pixel unit in an even column are first regions or all the three sub-pixel regions corresponding to a same pixel unit in an even column are second regions. Alternatively, the sub-pixel regions corresponding to the pixel units in an even column in the display panel are the third regions; and in the sub-pixel regions corresponding to the pixel units in an odd column, the first regions and the second regions in a same column of the sub-pixel regions are arranged alternatively in a column Y, the sub-pixel region corresponding to the pixel unit in an odd column is the first region or the second region; and all the three sub-pixel regions corresponding to a same pixel unit in an odd column are first regions or all the three sub-pixel regions corresponding to a same pixel unit in an odd column are second regions.

In this way, when the OLED driving circuits in an odd row are scanned, a driving voltage is inputted to the anodes of the sub-pixels of the third regions in the odd row, a driving voltage is inputted to the anodes of the sub-pixels of other-than-third regions in an even row adjacent to the odd row in a same group with other-than-third regions in the odd row. After the OLED driving circuits in all the odd rows are scanned, the driving voltage is inputted to all the anodes of the sub-pixels of the third regions in the odd rows, and the driving voltage is inputted to all the anodes of the sub-pixels of the other-than-third regions in the even rows. It should be noted that the "other-than-third region" refers to a region different from the third region. Similarly, when the OLED driving circuits in an even row are scanned, a driving voltage is inputted to the anodes of the sub-pixels of the third regions in the even row, and a driving voltage is inputted to the anodes of the sub-pixels of other-than-third regions in an odd row adjacent to the even row in a same group with other-than-third regions in the even row. After the OLED driving circuits in all the even rows are scanned, the driving voltage is inputted to all the anodes of the sub-pixels of the third regions in the even rows, and the driving voltage is inputted to all the anodes of the sub-pixels of the other-than-third regions in the odd rows. The display principle is shown in FIG. 5, which is a schematic structural diagram of a layout of pixel units of a display panel according to an embodiment of the present disclosure.

Figure 5:
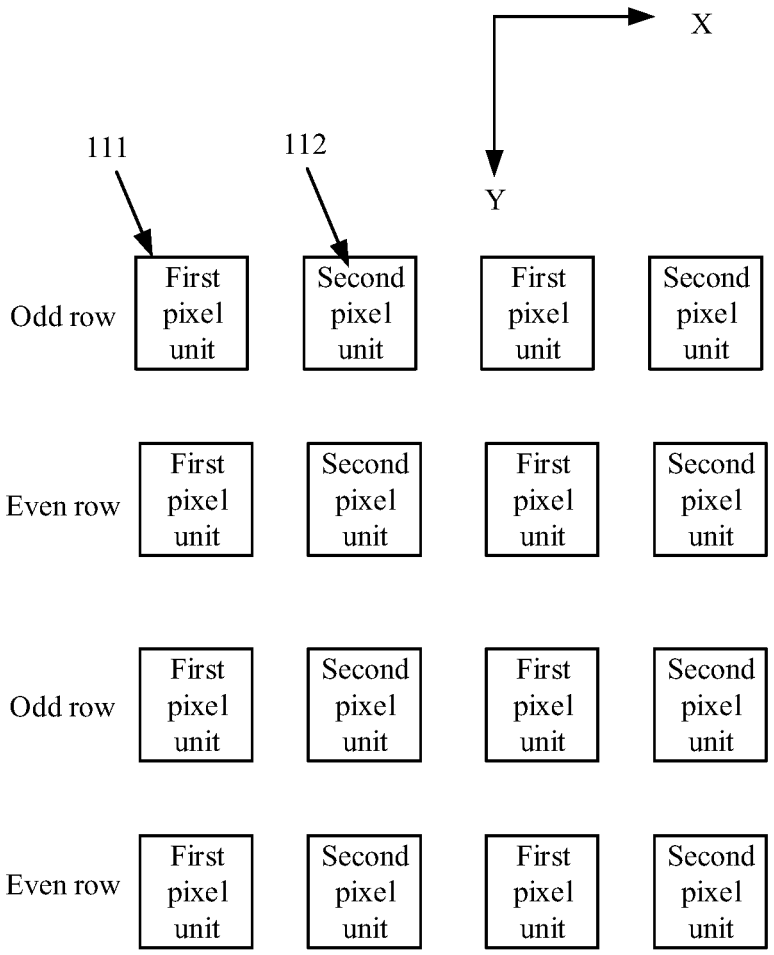
FIG. 5 is a schematic structural diagram of a layout of pixel units of a display panel according to an embodiment of the present disclosure.

In FIG. 5, a pixel unit including third regions is a first pixel unit 111, and three sub-pixel regions corresponding to the first pixel unit 111 are third regions. A pixel unit including first regions or second regions is a second pixel unit 112. All the three sub-pixel regions corresponding to the second pixel unit 112 are first regions or all the three sub-pixel regions corresponding to the second pixel unit 112 are second regions.

When any odd row is scanned, the OLED driving circuits in the odd row are turned on, the OLED driving circuits in the first pixel unit 111 provide a supply voltage to sub-pixels in a same sub-pixel region with the OLED driving circuits respectively, the OLED driving circuits in the second pixel unit 112 in the odd row provide a supply voltage to sub-pixels in an even row and in a same group with the OLED driving circuits respectively, a supply voltage is inputted to sub-pixels of the sub-pixel regions in the second pixel unit 112 in the even row, and the sub-pixels in the first pixel unit 111 in the odd row and the sub-pixels in the second pixel unit 112 in the even row in a same group with the second pixel unit 112 in the odd row are in a light-emitting state. Since the OLED driving circuit in an even row holds the data signal of the OLED driving circuit at a previous frame, the sub-pixels of the first pixel unit 111 in any even row and the second pixel unit 112 in an odd row in a same group with the second pixel unit 112 in the even row are conductive with the power supply, then the sub-pixels of the first pixel unit 111 in the even row and the second pixel unit 112 in the odd row in a same group with the second pixel unit 112 in the even row are in a light-emitting state.

A pixel unit in an odd row in a same group with a pixel unit in an even row means that the pixel unit in the odd row and the pixel unit in the even row include first regions in a same group and second regions in a same group.

Similarly, when any even row is scanned, a supply voltage is inputted to the sub-pixels in the first pixel unit 111 in the even row, a supply voltage is inputted to the sub-pixels in the second pixel unit 112 in an odd row in a same group with the second pixel unit 112 in the even row, and the sub-pixels in the first pixel unit 111 in the even row and the sub-pixels in the second pixel unit 112 in the odd row in a same group with the second pixel unit 112 in the even row are in a light-emitting state. Since the OLED driving circuit in an odd row holds the data signal of the OLED driving circuit at a previous frame, the sub-pixels of the first pixel unit 111 in the odd row and the second pixel unit 112 in an even row in a same group with the second pixel unit 112 in the odd row are conductive with the power supply, then the sub-pixels of the first pixel unit 111 in the odd row and the second pixel unit 112 in the even row in a same group with the second pixel unit 112 in the odd row are in a light-emitting state.

In the above driving method, a data signal from a current frame is used to drive one half of the pixel units, and the other half of the pixel units are driven by a data signal at a previous frame through holding the data signal. The data signal at the current frame and the data signal at the previous frame drive all the pixel units to display a frame of image. A level flip is not performed on the gate line connected with the pixel units holding the data signal, thereby reducing the power consumption.

Based on the embodiment of the above display panel, a driving method is provided according to another embodiment of the present disclosure, and the driving method is configured to drive the display panel according to the above embodiment to display. The driving method includes: scanning the OLED driving circuits in all even rows and the OLED driving circuits in all odd rows in a time-sharing manner; displaying, by the sub-pixels connected with the OLED driving circuits in all the even rows, a frame of image and turning off the sub-pixels connected with the OLED driving circuits in all the odd rows, when the OLED driving circuits in all the even rows are sequentially scanned in a preset scanning order; and displaying, by the sub-pixels connected with the OLED driving circuits in all the odd rows, a frame of image and turning off the sub-pixels connected with the OLED driving circuits in all the even rows, when the OLED driving circuits in all the odd rows are sequentially scanned in a preset scanning order.

Turning off the sub-pixels connected with the OLED driving circuit means that no scanning signal is inputted to the gate lines connected with the OLED driving circuits, and the power supply does not output a supply voltage. In this way, when capacitors in the OLED driving circuits are discharged, and the sub-pixels are conductive with the power supply, no supply voltage is inputted to the sub-pixels, and the sub-pixels are in a no-light-emitting state.

Figure 6:
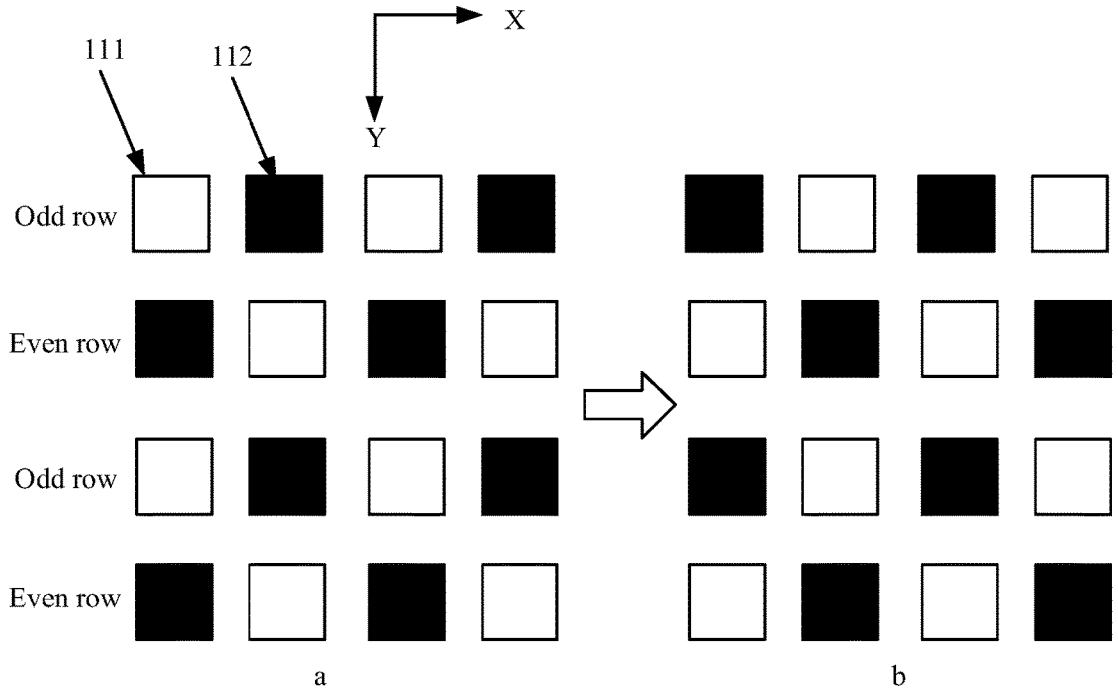
FIG. 6 is a schematic diagram showing a display principle of a display panel according to an embodiment of the present disclosure.

Similarly, the driving method according to the present embodiment adopts the layout of the pixel units in the above driving method. The present driving method is different from the above driving method in that a display is performed by a half of the pixel units, as shown in FIG. 6, which is a schematic diagram showing a display principle of a display panel according to an embodiment of the present disclosure. In FIG. 6, a pixel unit in which the sub-pixel is turned off is indicated by a black square, and a pixel unit in which the sub-pixel displaying a screen is indicated by a white square.

As shown in drawing a in FIG. 6, when any odd row is scanned, the OLED driving circuits in the odd row are turned on, the OLED driving circuits in the first pixel unit 111 provide a supply voltage to sub-pixels in a same sub-pixel region with the OLED driving circuits respectively, the OLED driving circuits in the second pixel unit 112 in the odd row provide a supply voltage to sub-pixels in an even row and in a same group with the OLED driving circuits respectively, a supply voltage is inputted to sub-pixels of the sub-pixel regions in the second pixel unit 112 in the even row, and the sub-pixels in the first pixel unit 111 in the odd row and the sub-pixels in the second pixel unit 112 in the even row in a same group with the second pixel unit 112 in the odd row are in a light-emitting state. Since the sub-pixels connected with the OLED driving circuits in each even row are turned off, the sub-pixels of the first pixel unit 111 in the even row and the second pixel unit 112 in an odd row in a same group with the second pixel unit 112 in the even row are turned off and are in a no-light-emitting state.

Similarly, as shown in drawing b in FIG. 6, when any even row is scanned, a supply voltage is inputted to the sub-pixels in the first pixel unit 111 in the even row, a supply voltage is inputted to the sub-pixels in the second pixel unit 112 in an odd row in a same group with the second pixel unit 112 in the even row, and the sub-pixels in the first pixel unit 111 in the even row and the sub-pixels in the second pixel unit 112 in the odd row in a same group with the second pixel unit 112 in the even row are in a light-emitting state. Since the sub-pixels connected with the OLED driving circuits in each odd row are turned off, the sub-pixels of the first pixel unit 111 in the odd row and the second pixel unit 112 in an even row in a same group with the second pixel unit 112 in the odd row are turned off and are in a no-light-emitting state.

Regardless of the driving manner shown in FIG. 5 or FIG. 6, it is necessary to scan odd rows and even rows in a time-sharing manner. A scanning period can be halved with respect to a scanning period in the prior art. For example, a conventional scanning frequency is 60 Hz, a scanning frequency in the driving method according to the present disclosure may be set to 30 Hz.

For example, even rows are scanned, data is written to the sub-pixels in the even rows, the sub-pixels in odd rows hold the data from a previous frame and emit light, and a light-emitting duration is 16.67 ms (light-emitting is performed from the previous frame to a current frame, so the light-emitting duration is 1 s/60≈16.67 ms). Odd rows are scanned after the even rows, data is written to the sub-pixels in the odd rows. Similarly, the sub-pixels in the even rows hold the data from the previous frame and emit light, and a light-emitting duration is 16.67 ms. Compared with the existing driving method of the display panel, only a half of gate drivers and a half of source drivers output at the same time, thereby reducing the power consumption.

In a 30 Hz driving frequency, an obvious flicker occurs in a display panel of a conventional design. In the display panel shown in FIG. 4, only a half of pixel units are driven in the time for one frame, so the flicker is reduced effectively, thereby achieving the purpose of reducing the power consumption and having no impact on the display effect. The experimental test shows that the flicker in the present scheme is −69 dB, which meets the standard of less than −30 dB.

The data signal at a frame for driving in drawing part a and the data signal at a frame for driving in drawing part b are data signals at two sequential frames. In the driving method, the data signal at a frame is configured to drive one half of the pixel units to display one frame of image. When any frame of image is displayed, a half of the pixel units are turned off, to save the power consumption and prolong the service life.

Figure 7:
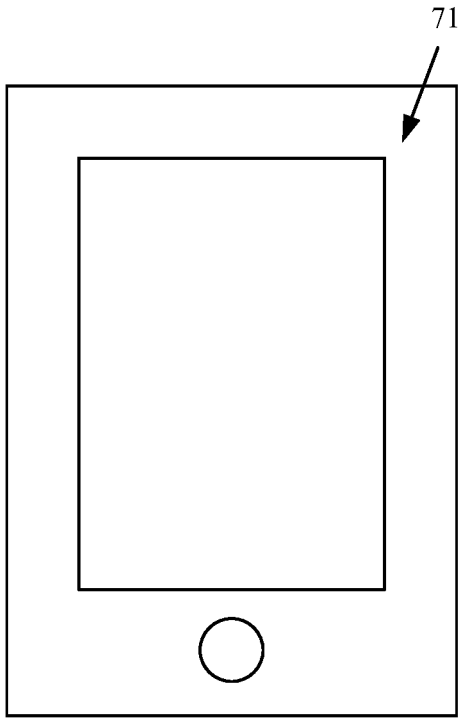
FIG. 7 is a schematic structural diagram of an electronic device according to an embodiment of the present disclosure.

Based on the above embodiment of a display panel, an electronic device is provided according to another embodiment of the present disclosure, as shown in FIG. 7, which is a schematic structural diagram of an electronic device according to an embodiment of the present disclosure. The electronic device includes a display panel 71, which is the display panel according to the above embodiments.

The electronic device may be a mobile phone, a tablet personal computer, a television and other electronic devices with a touch display function. The electronic device adopts the display panel according to the above embodiment, to reduce the power consumption and improve the scanning usage.

Various embodiments of the present specification are described in a progressive manner, each embodiment focuses on differences from other embodiments, and same and similar parts of the various embodiments are referred to each other. For the embodiment of the disclosed driving method, it corresponds to the embodiment of the disclosed display panel, so the description for the driving method is relatively simple, and the correlation section can be referred to the embodiment of the display panel.

Those skilled in the art can realize or use the present disclosure based on the foregoing descriptions of the disclosed embodiments. Numerous modifications to these embodiments will be readily apparent to those skilled in the art, and the generic principles defined herein may be implemented in other embodiments without departing from the spirit or scope of the present disclosure. Accordingly, the present disclosure is not intended to be limited to the embodiments described herein, but is to be comply with the widest scope consistent with the principles and novel features disclosed herein.

The invention claimed is:

1. A display panel, comprising:

a plurality of pixel units arranged in an array, wherein each of the pixel units comprises a plurality of sub-pixels arranged in a row direction of the array;

a plurality of gate lines in parallel;

a plurality of data lines in parallel, wherein the data lines and the gate lines are insulated and crossed to define a plurality of sub-pixel regions, the sub-pixel regions are in a one-to-one correspondence with the sub-pixels, each of the sub-pixel regions is provided with one sub-pixel, each of the sub-pixel regions is also provided with an organic light emitting diode (OLED) driving circuit, OLED driving circuits in a same column are connected with one of the data lines, and OLED driving circuits in a same row are connected with one of the gate lines; and at least two sub-pixel regions adjacent to each other in a column direction of the array, wherein one of the at least two sub-pixel regions is a first region, the other one of the at least two sub-pixel regions is a second region, and in the first region and the second region in a same group, the sub-pixel in the first region is connected with the OLED driving circuit in the second region, and the sub-pixel in the second region is connected with the OLED driving circuit in the first region; wherein a first anode of the sub-pixel in the first region extends to the second region, and is connected with the OLED driving circuit in the second region through a via hole; and a second anode of the sub-pixel in the second region extends to the first region, and is connected with the OLED driving circuit in the first region through another via hole.

2. A display panel, comprising:

a plurality of pixel units arranged in an array, wherein each of the pixel units comprises a plurality of sub-pixels arranged in a row direction of the array;

a plurality of gate lines in parallel;

a plurality of data lines in parallel, wherein the data lines and the gate lines are insulated and crossed to define a plurality of sub-pixel regions, the sub-pixel regions are in a one-to-one correspondence with the sub-pixels, each of the sub-pixel regions is provided with one sub-pixel, each of the sub-pixel regions is also provided with an organic light emitting diode (OLED) driving circuit, OLED driving circuits in a same column are connected with one of the data lines, and OLED driving circuits in a same row are connected with one of the gate lines; and at least two sub-pixel regions adjacent to each other in a column direction of the array, wherein one of the at least two sub-pixel regions is a first region, the other one of the at least two sub-pixel regions is a second region, and in the first region and the second region in a same group, the sub-pixel in the first region is connected with the OLED driving circuit in the second region, and the sub-pixel in the second region is connected with the OLED driving circuit in the first region;

wherein the display panel further comprises 2N rows of the pixel units, with N being a positive integer, wherein for the pixel units in odd columns, the sub-pixel and the OLED driving circuit in a same sub-pixel region are connected with each other; and for the pixel units in even columns, the sub-pixel regions corresponding to each of the pixel units in the a-th row are the first regions, the sub-pixel regions corresponding to each of the pixel units in the (a+1)-th row are the second regions, and $0<a+1<2N$, a is an odd number, and the first regions corresponding to the pixel unit in the a-th row are in a same group with the second regions corresponding to the pixel unit in the (a+1)-th row respectively.

3. A display panel, comprising:

a plurality of pixel units arranged in an array, wherein each of the pixel units comprises a plurality of sub-pixels arranged in a row direction of the array;

a plurality of gate lines in parallel;

a plurality of data lines in parallel, wherein the data lines and the gate lines are insulated and crossed to define a plurality of sub-pixel regions, the sub-pixel regions are in a one-to-one correspondence with the sub-pixels, each of the sub-pixel regions is provided with one sub-pixel, each of the sub-pixel regions is also provided with an organic light emitting diode (OLED) driving circuit, OLED driving circuits in a same column are connected with one of the data lines, and OLED driving circuits in a same row are connected with one of the gate lines; and at least two sub-pixel regions adjacent to each other in a column direction of the array, wherein one of the at least two sub-pixel regions is a first region, the other one of the at least two sub-pixel regions is a second region, and in the first region and the second region in a same group, the sub-pixel in the first region is connected with the OLED driving circuit in the second region, and the sub-pixel in the second region is connected with the OLED driving circuit in the first region;

wherein the display panel further comprises 2N rows of the pixel units, with N being a positive integer, wherein for the pixel units in even columns, the sub-pixel and the OLED driving circuit in a same sub-pixel region are connected with each other; and for the pixel units in odd columns, each of the sub-pixel regions corresponding to each of the pixel units in the a-th row is the first region, each of the sub-pixel regions corresponding to each of the pixel units in the (a+1)-th row is the second region, and $0<a<2N$, a is an odd number, and the first region corresponding to the pixel unit in the a-th row is in a same group with the second region corresponding to the pixel unit in the (a+1)-th row and in a same column with the first region.

4. The display panel according to claim 2, wherein the gate lines are connected with gate drivers configured to provide scanning signals to the gate lines, and the data lines are connected with a source driver configured to provide data signals to the data lines; wherein the gate drivers comprise a first gate driver and a second gate driver, the OLED driving circuits in an even row are connected with the first gate driver through the gate line connected with the OLED driving circuits, and the OLED driving circuits in an odd row are connected with the second gate driver through the gate line connected with the OLED driving circuits.

5. The display panel according to claim 3, wherein the gate lines are connected with gate drivers configured to provide scanning signals to the gate lines, and the data lines are connected with a source driver configured to provide data signals to the data lines; wherein the gate drivers comprise a first gate driver and a second gate driver, the OLED driving circuits in an even row are connected with the first gate driver through the gate line connected with the OLED driving circuits, and the OLED driving circuits in an odd row are connected with the second gate driver through the gate line connected with the OLED driving circuits.

6. The display panel according to claim 4, wherein the first gate driver and the second gate driver are arranged at both ends of the gate lines respectively.

7. The display panel according to claim 1, wherein each of the sub-pixels is an OLED unit, the OLED unit comprises a third anode, a cathode opposite to the third anode and a light-emitting functional layer between the third anode and the cathode, and the cathode is configured to input a cathode voltage, wherein the third anode of the sub-pixel in the first region is the first anode, and the third anode of the sub-pixel in the second region is the second anode; and each of the pixel units comprises three sub-pixels, and the three sub-pixels of a same pixel unit are a red-light-emitting OLED unit, a green-light-emitting OLED unit and a blue-light-emitting OLED unit respectively.

8. The display panel according to claim 7, wherein the OLED driving circuit comprises a driving transistor, and the driving transistor comprises:

a gate configured to receive a data signal, a first electrode configured to receive a supply voltage signal, and a second electrode electrically connected with the third anode of the OLED unit corresponding to the driving transistor.

9. The display panel according to claim 8, wherein the OLED driving circuit further comprises a first switching transistor and a capacitor, the first switching transistor comprises: a gate electrically connected with one of the gate lines, a first electrode electrically connected with one of the data lines, and a second electrode electrically connected with the gate of the driving transistor and one plate of the capacitor, wherein the other plate of the capacitor is grounded.

10. A driving method applied to a display panel, wherein the display panel comprises:

a plurality of pixel units arranged in an array, wherein each of the pixel units comprises a plurality of sub-pixels arranged in a row direction of the array;

a plurality of gate lines in parallel;

a plurality of data lines in parallel, wherein the data lines and the gate lines are insulated and crossed to define a plurality of sub-pixel regions, the sub-pixel regions are in a one-to-one correspondence with the sub-pixels, each of the sub-pixel regions is provided with one sub-pixel, each of the sub-pixel regions is also provided with an organic light emitting diode (OLED) driving circuit, OLED driving circuits in a same column are connected with one of the data lines, and OLED driving circuits in a same row are connected with one of the gate lines; and at least two sub-pixel regions adjacent to each other in a column direction of the array, wherein one of the at least two sub-pixel regions is a first region, the other one of the at least two sub-pixel regions is a second region, and in the first region and the second region in a same group, the sub-pixel in the first region is connected with the OLED driving circuit in the second region, the sub-pixel in the second region is connected with the OLED driving circuit in the first region, wherein a first anode of the sub-pixel in the first region extends to the second region and is connected with the OLED driving circuit in the second region through a via hole, and a second anode of the sub-pixel in the second region extends to the first region and is connected with the OLED driving circuit in the first region through another via hole, and wherein the driving method comprises:

scanning the OLED driving circuits in all even rows and the OLED driving circuits in all odd rows in a time-sharing manner;

holding, by each of the OLED driving circuits in all the odd rows, a data signal of the OLED driving circuit at a previous frame, when the OLED driving circuits in all the even rows are sequentially scanned in a preset scanning order;

holding, by each of the OLED driving circuits in all the even rows, a data signal of the OLED driving circuit at a previous frame, when the OLED driving circuits in all the odd rows are sequentially scanned in a preset scanning order;

inputting, by each of the OLED driving circuits in the first regions, the data signal to the sub-pixel in the second region in a same group with the first region, when the OLED driving circuit in the first region is scanned; and inputting, by each of the OLED driving circuits in the second regions, the data signal to the sub-pixel in the first region in a same group with the second region, when the OLED driving circuit in the second region is scanned.

11. The driving method according to claim 10, wherein a scanning timing of the OLED driving circuits in all the even rows and a scanning timing of the OLED driving circuits in all the odd rows are performed alternatively.

12. An electronic device comprising the display panel of claim 1.

13. The electronic device according to claim 12, wherein the display panel comprises 2N rows of the pixel units, with N being a positive integer, wherein for the pixel units in odd columns, the sub-pixel and the OLED driving circuit in a same sub-pixel region are connected with each other; and for the pixel units in even columns, the sub-pixel regions corresponding to each of the pixel units in the a-th row are the first regions, the sub-pixel regions corresponding to each of the pixel units in the (a+1)-th row are the second regions, and $0<a+1<2N$, a is an odd number, and the first regions corresponding to the pixel unit in the a-th row are in a same group with the second regions corresponding to the pixel unit in the (a+1)-th row respectively.

14. The electronic device according to claim 12, wherein the display panel comprises 2N rows of the pixel units, with N being a positive integer, wherein for the pixel units in even columns, the sub-pixel and the OLED driving circuit in a same sub-pixel region are connected with each other; and for the pixel units in odd columns, each of the sub-pixel regions corresponding to each of the pixel units in the a-th row is the first region, each of the sub-pixel regions corresponding to each of the pixel units in the (a+1)-th row is the second region, and $0<a<2N$, a is an odd number, and the first region corresponding to the pixel unit in the a-th row is in a same group with the second region corresponding to the pixel unit in the (a+1)-th row and in a same column with the first region.

15. The electronic device according to claim 13, wherein the gate lines are connected with gate drivers configured to provide scanning signals to the gate lines, and the data lines are connected with a source driver configured to provide data signals to the data lines; wherein the gate drivers comprise a first gate driver and a second gate driver, the OLED driving circuits in an even row are connected with the first gate driver through the gate line connected with the OLED driving circuits, and the OLED driving circuits in an odd row are connected with the second gate driver through the gate line connected with the OLED driving circuits.

16. The electronic device according to claim 14, wherein the gate lines are connected with gate drivers configured to provide scanning signals to the gate lines, and the data lines are connected with a source driver configured to provide data signals to the data lines; wherein the gate drivers comprise a first gate driver and a second gate driver, the OLED driving circuits in an even row are connected with the first gate driver through the gate line connected with the OLED driving circuits, and the OLED driving circuits in an odd row are connected with the second gate driver through the gate line connected with the OLED driving circuits.

17. The electronic device according to claim 15, wherein the first gate driver and the second gate driver are arranged at both ends of the gate lines respectively.

18. The electronic device according to claim 12, wherein each of the sub-pixels is an OLED unit, the OLED unit comprises a third anode, a cathode opposite to the third anode and a light-emitting functional layer between the third anode and the cathode, and the cathode is configured to input a cathode voltage, wherein the third anode of the sub-pixel in the first region is the first anode, and the third anode of the sub-pixel in the second region is the second anode; and each of the pixel units comprises three sub-pixels, and the three sub-pixels of a same pixel unit are a red-light-emitting OLED unit, a green-light-emitting OLED unit and a blue-light-emitting OLED unit respectively.

* * * * *